US006478983B1

(12) United States Patent
Matsuura et al.

(10) Patent No.: US 6,478,983 B1
(45) Date of Patent: Nov. 12, 2002

(54) LUBRICATING OIL FOR COMPRESSION REFRIGERATOR AND REFRIGERATING/ AIR CONDITIONING APPARATUS USING THE SAME

(75) Inventors: Hideki Matsuura, Sakai (JP); Masaki Nomura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/308,537

(22) PCT Filed: Oct. 15, 1998

(86) PCT No.: PCT/JP98/04654

§ 371 (c)(1),
(2), (4) Date: May 21, 1999

(87) PCT Pub. No.: WO99/20718

PCT Pub. Date: Apr. 29, 1999

(30) Foreign Application Priority Data

Oct. 17, 1997 (JP) ..... 9-285422
Jun. 19, 1998 (JP) ..... 10-173323

(51) Int. Cl.[7] ..... C09K 5/00; C10M 105/18; C10M 105/34; C10M 105/38

(52) U.S. Cl. ..... 252/68; 508/579; 508/583; 252/67

(58) Field of Search ..... 252/68, 67; 508/579, 508/583

(56) References Cited

U.S. PATENT DOCUMENTS 4,851,144 A * 7/1989 McGraw et al. ..... 252/68
4,900,463 A * 2/1990 Thomas et al. ..... 252/68
4,948,525 A * 8/1990 Sasaki et al. ..... 252/68
5,037,570 A * 8/1991 Gorski et al. ..... 252/68
5,053,155 A * 10/1991 Mahler ..... 252/68
5,254,280 A * 10/1993 Thomas et al. ..... 252/68
5,372,737 A * 12/1994 Spauschus ..... 252/68
5,449,472 A * 9/1995 Egawa et al. ..... 252/68
5,454,963 A * 10/1995 Kaneko ..... 252/68
5,543,068 A * 8/1996 Kaimai et al. ..... 252/68
5,595,678 A 1/1997 Short et al. ..... 252/68
5,801,132 A * 9/1998 Kaneko et al. ..... 252/68
6,080,705 A * 6/2000 Kamai et al.
6,193,906 B1 * 2/2001 Kaneko et al.

FOREIGN PATENT DOCUMENTS

EP 0 803 564 A2 10/1997
EP 0861883 * 9/1998
EP 0 881 278 A1 12/1998
JP A4 39394 2/1992
JP A 5032985 2/1993
JP 5032985 * 6/1993
JP A8 100187 4/1996
JP A8 269473 10/1996
JP A8 337785 12/1996
JP A9 20898 1/1997
JP A9 71793 3/1997
WO WO 98/26024 6/1998
WO 99/58628 * 11/1999

* cited by examiner

*Primary Examiner*—Margaret Einsmann
(74) *Attorney, Agent, or Firm*—Birch, Stewart, Kolasch & Birch, LLP

(57) ABSTRACT

There is obtained a lubricating oil having good solubility with both HFC refrigerant and contaminants by adding PAG having a viscosity of not more than 70 cSt (40° C.) to a synthetic lubricating oil, such as polyvinyl ether and ester oils at an amount of not less than 0.1 wt % and not more than 20 wt % (desirably, not less than 20 wt % and not more than 10 wt %). Therefore, in a refrigerating/air-conditioning machine equipped with a compressor using this present lubricating oil together with a HFC refrigerant as a working fluid, deflection in the ratio of the mixture within the machines is not caused and, consequently, the efficiency for washing capillary tubes is not reduced. In that case, a high-reliable refrigerating/air-conditioning machine can be obtained at a low price without any modification of the refrigerating/air-conditioning machine.

11 Claims, 5 Drawing Sheets

*Fig.1*

| | Additives added to PVE | Avg. Mol. Weight | Viscosity | Addition amount | Flow reduction rate |
|---|---|---|---|---|---|
| a | 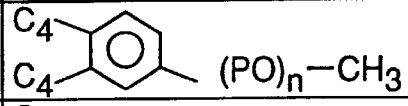 $(PO)_n-CH_3$ | 380 | 15cSt | 10wt% | 8~12% |
| b | 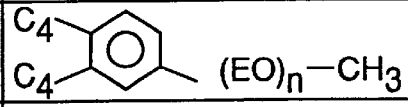 $(EO)_n-CH_3$ | 380 | 15cSt | 10wt% | 10~17% |
| c | $C_4-(PO)_n(EO)_m-OH$ n / m=7 / 3 | 380 | 15cSt | 10wt% | 10~17% |
| d | $C_4-O-(BO)_n(EO)_m-H$ n / m=7 / 3 | 1050 | 68cSt | 10wt% | 0~5% |
| e | ↑ | 1050 | 68cSt | 2.5wt% | 0~10% |
| f | ↑ | 1050 | 68cSt | 5wt% | 0~10% |
| g | ↑ | 1050 | 68cSt | 7.5wt% | 0~5% |
| h | $C_{12}-O-(BO)_n(EO)_m-H$ n / m=7 / 3 | 1100 | 68cSt | 10wt% | 0~5% |
| i | $C_4-O-(BO)_n(EO)_m-H$ n / m=7 / 3 | 660 | 32cSt | 10wt% | 0~5% |

Additives $R1(R2O)_n(R3O)_mR4$ n and m are integers.

R1: Alkyl group

R2, R3: Alkyl group having a carbon number of 2-4

R4: Hydrogen or alkyl group

*Fig.2*

| | Additives added to PVE | Avg. Mol. Weight | Viscosity | Addition amount | Flow reduction rate |
|---|---|---|---|---|---|
| j | $C_4-O-(BO)_n(EO)_m-H$ n / m=7 / 3 | 500 | 15cSt | 2.5wt% | 0~5% |
| k | $C_4-O-(BO)_n(EO)_m-H$ n / m=8 / 2 | 950 | 68cSt | 5wt% | 0~5% |
| l | ↑ | 950 | 68cSt | 2.5wt% | 0~5% |
| m | $C_4-O-(BO)_n(EO)_m-H$ n / m=9 / 1 | 920 | 68cSt | 5wt% | 0~5% |
| n | ↑ | 920 | 68cSt | 2.5wt% | 0~5% |
| o | alkyl$-O-(PO)_n(EO)_m-H$ n / m=3 / 2 | 400 | 15cSt | 2.5wt% | 5~10% |

Additives $R1(R2O)_n(R3O)_mR4$ n and m are integers.

R1: Alkyl group

R2, R3: Alkyl group having a carbon number of 2-4

R4: Hydrogen or alkyl group

| | | Avg. Mol. Weight | Viscosity | Addition amount | Flow reduction rate |
|---|---|---|---|---|---|
| p | (R22/*Suniso Oil*) | — | — | — | 5~10% |
| q | (HFC / PVE) | — | — | — | 12~20% |
| r | (HFC / POE) | — | — | — | 25~33% |
| s | PVE / Polybutene | 300 | 10cSt | 10wt% | 20~25% |
| t | PVE / Alkylnaphthalene   | 600 | 32cSt | 30wt% | 25~30% |

LUBRICATING OIL FOR COMPRESSION REFRIGERATOR AND REFRIGERATING/ AIR CONDITIONING APPARATUS USING THE SAME

This application is the national phase under 35 U.S.C. §371 of PCT International Application No. PCT/JP98/04654 which has an International filing date of Oct. 15, 1998, which designated the United States of America.

TECHNICAL FIELD

The present invention relates to a lubricating oil for a compression refrigerating machine, which is used together with a hydrofluorocarbon refrigerant and a refrigerating/air-conditioning machine using the same.

BACKGROUND ART

Many attempts have hitherto been made to prevent choking phenomena in capillary tubes and expansion valves caused by contaminants generated by changing refrigerant systems from hydrochlorofluorocarbon (HCFC) to hydrofluorocarbon (HFC). For example, in "Refrigerator and Refrigerant Compressor" disclosed in JP-A 103616/1995, a filter composed of a membrane material, such as fluororesin and cellulose mixed ester, is used in a refrigerant passage. In addition, in "Refrigerator and Refrigerant Compressor" disclosed in JP-A 235569/1994, a filter composed of a porous sintered metal and having a pore size of not more than 80 $\mu$m is inserted in a dryer of a refrigerating machine. Further, in "Refrigerator" disclosed in JP-A 105673/1996, the removal of sludge is performed by blowing capillary tubes with a high-pressure gas during the operation.

In addition, in "Refrigerating Cycle" disclosed in JP-A 247582/1996, in order to prevent various kinds of harm caused by the accumulation of contaminants generated during refrigerating cycling, (1) a plurality of mechanisms provided with a tube charged with a filler or a branching valve for dividing a refrigerant passage are used as a throttling mechanism; and (2) a scavenging tube is provided through a directional control valve apart from a regular passage, or (3) a synthetic ester oil and a mineral oil of any one of a naphthene mineral oil, a paraffin mineral oil and an alkyl benzene mineral oil are used at a specified ratio as a lubricating oil for a compressor. Further, in "Refrigerator Composition and Refrigerating Cycle" disclosed in JP-A 143486/1997, a refrigerating machine oil containing a base oil composed of a mixture of 5–30 parts by weight of any one of mineral oils of a naphthene mineral oil, a paraffin mineral oil, a poly $\alpha$-olefin mineral oil and an alkylbenzene mineral oil, and 70–95 parts by weight of polyol ester is used in order to prevent the choking phenomenon caused by an ester refrigerating machine oil.

However, in the cases of "Refrigerator and Refrigerant Compressor" disclosed in JP-A 103616/1995, "Refrigerator and Refrigerant Compressor" disclosed in JP-A 235569/1994, "Refrigerator" disclosed in JP-A 105673/1996, and "Refrigerating Cycle" disclosed in JP-A 247582/1996, there is a problem that a filter, a high-pressure gas blower, a throttling mechanism charged with a filler, and a tube for scavenging contaminants are additionally required since the previous refrigerators and air conditioners can not be used as they are, leading to an increased cost. In addition, when the aforementioned filters are utilized, there arises a further problem that the filters themselves are clogged.

In addition, in the cases of "Refrigerating Cycle" disclosed in JP-A 247582/1996 and "Refrigerator Composition and Refrigerating Cycle" disclosed in JP-A 143486/1997, the above refrigerating machine oil has bad miscibility with HFC refrigerants and, especially in the case of R410A, there is a problem that an amount thereof to be mixed is highly restricted. Further, there is also a problem that, depending upon the operating conditions, the occurrence of deflection in the ratio of the mixed oil within the refrigerating machine reduces the efficiency for washing capillary tubes.

DISCLOSURE OF THE INVENTION

The present invention was done to overcome the above previous drawbacks. It is an object of the present invention to provide a lubricating oil, which can prevent choking caused by contaminants in capillary tubes and expansion valves in the use of a HFC refrigerant, for a compression refrigerating machine without any modification of the machine, and a refrigerating/air-conditioning machine using the same.

In order to attain the above object, the present invention features a lubricating oil for a compression refrigerating machine, used together with a HFC refrigerant, which comprises a compound having the following general formula:

$$R^1(R^2O)_n(R^3O)_mR^4$$

wherein $R^1$: any one of alkyl group, alkoxy group and aryl group;

$R^2$: alkylene group having a carbon number of 2–4;

$R^3$: alkylene group having a carbon number of 2–4;

$R^4$: hydrogen or alkyl group.

In this essential feature, a compound having the miscibility with a HFC refrigerant and the solubility with contaminants generated in the use of the HFC refrigerant is added to the present lubricating oil for a compression refrigerating machine. Therefore, the deflection in the ratio between the present lubricating oil and the HFC refrigerant within the above refrigerating/air-conditioning machine is not caused by using the present lubricating oil together with a HFC refrigerant as a working fluid for a compression refrigerating machine. Therefore, the reduction in the efficiency for washing capillary tubes and expansion valves can be prevented. That is, according to the present invention, the reliability of the refrigerating/air-conditioning machine using the HFC refrigerant may be enhanced without any modification thereof.

In addition, the present invention features a polyvinyl ether lubricating oil for a compression refrigerating machine, used together with a HFC refrigerant, which comprises a compound added at an amount of not less than 5 wt % and not more than 10 wt %, said compound having the following general formula:

$$R^1(C_4H_8O)_n(R^5O)_mR^4$$

wherein $R^1$: any one of alkyl group, alkoxy group and aryl group;

$R^4$: hydrogen or alkyl group;

$R^5$: alkylene group having a carbon number of 2–3;

n/m: 1/9–10/0.

In this essential feature, since the above compound contains butylene oxide ($C_4H_8O$) having a carbon number of 4, the solubility with the HFC refrigerant and the contaminants is very good. Moreover, the compound is added to the present polyvinyl ether lubricating oil for a compression refrigerating machine at an amount of not less than 5 wt %. Therefore, the rate of flow reduction caused by choking in the capillary tubes, expansion valves and the like of a refrigerating/air-conditioning machine using the present lubricating oil and the HFC refrigerant as a working fluid, can be sufficiently decreased to 0%–10%, and the choking caused by contaminants in capillary tubes and expansion valves can be effectively prevented. Further, since the amount of the above compound to be added to the present lubricating oil is not more than 10 wt %, the reduction in volume insulation resistance for the present lubricating oil as a whole can be decreased. Therefore, it is not possible that leakage current from a hermetic motor increases. That is, according to the present invention, the reliability of the refrigerating/air-conditioning machine using a HFC refrigerant may be enhanced without any modification thereof.

In addition, the present invention features a refrigerating/air-conditioning machine equipped with a compressor using a HFC refrigerant and a lubricating oil as a working fluid, which comprises a compound having the following general formula:

$$R^1(R^2O)_n(R^3O)_mR^4$$

wherein $R^1$: any one of alkyl group, alkoxy group and aryl group;

$R^2$: alkylene group having a carbon number of 2–4;

$R^3$: alkylene group having a carbon number of 2–4;

$R^4$: hydrogen or alkyl group.

In this essential feature, there is used, as a working fluid for a compressor of a refrigerating/air-conditioning machine, a lubricating oil with an added compound together with a HFC refrigerant, said compound has the miscibility with the HFC refrigerant and the solubility with contaminants generated in the use of the HFC refrigerant. Therefore, the deflection is not caused in the ratio between the above lubricating oil and the HFC refrigerant, and, consequently, the reduction in the efficiency for washing capillary tubes and expansion valves can be prevented. That is, according to the present invention, a high-reliable refrigerating/air-conditioning machine using a HFC refrigerant can be obtained at a low price without any modification thereof.

Further, one embodiment is characterized in that the amount of the above compound to be added to the lubricating oil is not less than 0.1 wt % and not more than 20 wt %.

In this essential feature, since the amount of the above compound to be added is 0.1 wt % or more, the flow reduction rate for refrigerating/air-conditioning machines can be decreased below the rate in the case where the previous HFC refrigerant/polyvinyl ether (or polyol ester) lubricating oils are used. Further, since the addition amount of the above compound having a low volume insulation resistivity is 20 wt % or less, it is not possible that the volume insulation resistivity for the whole lubricating oil becomes too small and, consequently, an increase in the leakage current from a hermetic motor makes the motor unusable.

Further, one embodiment is characterized in that the amount of the above compound to be added to the lubricating oil is not less than 2 wt % and not more than 10 wt %.

In this essential feature, the flow reduction rate in the refrigerating/air-conditioning machine can be decreased to 0%–17%. Therefore, choking caused by contaminants in capillary tubes and expansion valves can be effectively prevented.

Further, one embodiment is characterized in that the viscosity of the above compound at 40° C. is 70 cSt or less.

In this essential feature, since the viscosity of the above compound at 40° C. is 70 cSt or less, the molecular weight of the above compound should be below several thousands. Therefore, clogging with the above compound itself, caused by an increase in the viscosity to several ten thousands in a low-temperature region, such as capillary tubes, can be prevented.

Further, one embodiment is characterized in that the carbon number of either of the alkylene groups $R^2$ and $R^3$ in the above compound is 4.

In this essential feature, since the carbon number of the alkylene group is large, the solubility with HFC refrigerants or contaminants is enhanced, and, consequently, the flow reduction rate can be sufficiently decreased to 0%–10%. Therefore, choking caused by contaminants in capillary tubes and expansion valves can be prevented more effectively.

In addition, the present invention features a refrigerating/air-conditioning machine equipped with a compressor using, as a working fluid, a HFC refrigerant and a polyvinyl ether lubricating oil, to which a compound having the following general formula is added at an amount of not less than 5 wt % and not more than 10 wt %:

$$R^1(C_4H_8O)_n(R^5O)_mR^4$$

wherein $R^1$: any one of alkyl group, alkoxy group and aryl group;

$R^4$: hydrogen or alkyl group;

$R^5$: alkylene group having a carbon number of 2–3;

n/m: 1/9–10/0.

In this essential feature, since the above compound contains butylene oxide ($C_4H_8O$) having a carbon number of 4, the solubility with HFC refrigerants and contaminants is very good. Moreover, since the compound is added to a polyvinyl ether lubricating oil at an amount of not less than 5 wt %, the flow reduction rate in a refrigerating/air-conditioning machine can be sufficiently decreased to 0%–10%. Therefore, choking caused by contaminants in capillary tubes and expansion valves can be effectively prevented. Further, since the amount of the above compound to be added to the lubricating oil is 10 wt % or less, the reduction in volume insulation resistance for the whole lubricating oil can be decreased. Therefore, it is not possible that leakage current from a hermetic motor increases. That is, according to the present invention, a high-reliable refrigerating/air-conditioning machine using a HFC refrigerant can be obtained without any modification thereof.

Further, one embodiment is characterized in that the ratio n/m for n and m in the above general formula is 7/3 or more.

In this essential feature, since the ratio of n to m in the above general formula is 7/3 or more, the proportion of the butylene oxide is large and, consequently, the flow reduction rate in a refrigerating/air-conditioning machine can be further decreased to 0%–5%. Therefore, choking caused by contaminants in capillary tubes and expansion valves can be prevented more effectively.

Further, one embodiment is characterized in that the viscosity of the above compound at 40° C. is more than 32 cSt and not more than 70 cSt.

In this essential feature, since the viscosity of the above compound at 40° C. is above 32 cSt, the reduction in volume insulation resistance for the whole lubricating oil can be decreased. Further, since the viscosity of the above compound is 70 cSt or less, the molecular weight of the above compound should be below several thousands and, consequently, clogging with the above compound itself, caused by an increase in the viscosity to several ten-thousands in a low-temperature region, such as capillary tubes, can be prevented.

BRIEF DESCRIPTION OF THE DRAWINGS

FIG. 1 is a view showing the relationship between conditions for adding PAG to a refrigerating machine oil used in the refrigerating/air-conditioning machine of the present invention and the property therefrom.

FIG. 2 is a view showing the relationship between conditions for adding PAG to a refrigerating machine oil and the property therefrom, continued from FIG. 1.

BEST MODE FOR CARRYING OUT THE INVENTION

FIG. 1 and FIG. 2 are views showing the relationship between various conditions for adding polyalkylene glycol to a refrigeration machine oil used for the refrigerating/air-conditioning machine of this mode of the present invention and property therefrom. Additionally, the refrigerating/air-conditioning machine of this mode of the present invention is equipped with a compressor using a HFC refrigerant and a lubricating oil as a working fluid. In addition, the above polyalkylene glycol (PAG) is represented by the following general formula:

$$R^1(R^2O)_n(R^3O)_mR^4$$

wherein $R^1$: any one of alkyl group, alkoxy group and aryl group;

$R^2$: alkylene group having a carbon number of 2–4;

$R^3$: alkylene group having a carbon number of 2–4;

$R^4$: hydrogen or alkyl group.

Symbols a–n in the figures represent the case where polyvinyl ether (PVE) is used as a refrigerating machine oil, provided that the essential features of $R^1$–$R^4$ are varied in a–d. In addition, in d–g, k, l, m, and n, the amount to be added to PVE is varied with the essential features of $R^1$–$R^4$ fixed. Further, in h and i, the carbon number of $R^1$ is varied. Symbol o in the figure represents the case where an ester oil is used as a refrigerating machine oil. Additionally, the flow reduction rate in FIG. 1 and FIG. 2 is a rate of flow reduction caused by choking in capillary tubes, expansion valves and the like when a lubricating oil of the above PVE/PAG or ester oil/PAG is used together with a HFC refrigerant. Further, in FIG. 1, "PO" stands for propylene oxide, "EO" does ethylene oxide, and "BO" does butylene oxide.

Figure 3:
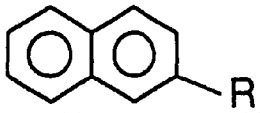
FIG. 3 is a view showing data for comparing with the results in FIG. 1 and FIG. 2.

FIG. 3 shows data for comparing with the results in FIG. 1 and FIG. 2. Symbols p–r in the figure represent the cases where no additive is added, and among them, p represents the case where refrigerant is HCFC $R^{22}$, and the refrigerating machine oil is Suniso Oil. In addition, q represents the case where the refrigerant is a HFC refrigerant, and the refrigerating machine oil is PVE. Further, r represents the case where the refrigerant is a HFC refrigerant and the refrigerating machine oil is a polyol ester (POE). Symbols s and t in the figure represent the cases where an additive is added and, among them, s represents the case where the refrigerant is PVE, and the additive is polybutene. Further, t represents the case where the refrigerating machine oil is PVE, and the additive is alkylnaphthalene. Additionally, the flow reduction rates in the cases of s and t are rates of flow reduction caused by choking in capillary tubes, expansion valves and the like when a lubricating oil of PVE/polybutene or PVE/alkylnaphthalene is used together with a HFC refrigerant.

FIGS. 1–3 indicate that the amount of PAG to be added is required to be 0.1 wt % or more in order to decrease the flow reduction rate below that in the case of HFC/PVE/- (q in FIG. 3). In addition, it is well known that the volume insulation resistivity of PAG is low (approximately $10^9$–$10^{10}$ Ωcm) and, when the addition amount is too large, the volume insulation resistivity for the whole refrigerating machine oil becomes too low and, consequently, an increase in the leakage current from a hermetic motor, which is usually used frequently for refrigerating/air-conditioning machines, makes the motor unusable. From this point of view, the amount of PAG to be added is required to be 20 wt % or less. That is, in this mode of the present invention, the amount of PAG addition is not less than 0.1 wt % and not more than 20 wt %. Additionally, when distinct effects are desired, it is desirable that the amount is not less than 2 wt % and not more than 10 wt %.

In addition, when the viscosity of PAG is above 70 cSt (40° C.), since the molecular weight should be above several thousands, the viscosity will increase to several ten-thousands cSt in a low-temperature region, such as a capillary tube, which may lead to clogging with PAG itself. On the other hand, even when the viscosity is remarkably low, the viscosity for the whole refrigerating machine oil will not decrease to be harmful, when the addition amount is around 0.1 wt %. From the above point, the viscosity of PAG at 40° C. in this mode of the present invention is set to 70 cSt or less.

From a–n in FIG. 1 and FIG. 2, it is seen that the flow reduction rate shows small values as 0%–17% when a HFC refrigerant and PVE are used, indicating that the addition of PAG to PVE is effective to prevent choking of capillary tubes, expansion valves and the like. In addition, in the case where the carbon number of the alkylene group $R^2$ of the above PAG is 4 (corresponding to d–n in FIG. 1 and FIG. 2), the flow reduction rate is much smaller than that for $R^{22}$ (HCFC refrigerant)/Suniso Oil when the amount to be added to PVE is 2.5 wt %–10 wt %. Therefore, it is seen that the flow reduction rate can be suppressed by setting the carbon number for either of the alkylene groups $R^2$ and $R^3$ to 4 rather than 3.

In addition, when the above HFC refrigerant and POE (ester oil) are used, the flow reduction rate is large (25%–33%) as shown by r in FIG. 3. However, as shown by o in FIG. 2, the flow reduction rate is sufficiently decreased to 5%–10% by adding PAG to an ester oil, demonstrating that the addition of the above PAG is effective to ester oils.

As described above, in this mode of the present invention, by adding PAG having a viscosity of not more than 70 cSt (40° C.) to a synthetic lubricating oil, such as PVE and ester oils, at an amount of not less than 0.1 wt % and not more than 20 wt % (desirably, not less than 2 wt % and not more than 10 wt %), lubricating oils having good solubility with both a HFC refrigerant and contaminants can be obtained.

Therefore, in a refrigerating/air-conditioning machine equipped with a compressor using the above lubricating oil together with a HFC refrigerant as a working fluid, the deflection in the ratio between the present lubricating oil and the HFC refrigerant is not caused within the machines and, consequently, a reduction in the efficiency for washing capillary tubes and expansion valves can be prevented. In that case, a high-reliable refrigerating/air-conditioning machine can be obtained at a low price without any modification of the machines.

Meanwhile, as described above, especially when the carbon number of alkylene group $R^2$ of the above PAG is "4", the flow reduction rate becomes small. Then, in the following mode of the present invention, the use of:

$$R^1(BO)_n(R^5O)_mR^4$$

wherein $R^1$: any one of alkyl group, alkoxy group and aryl group;

$R^4$: hydrogen or alkyl group;

$R^5$: alkylene group having a carbon number of 2–3;

n/m: 1/9–10/0.

is described in detail, in which $(R^2O)$ of PAG represented by the general formula $R^1(R^2O)_n(R^3O)_mR^4$ is substituted with "BO (butylene oxide)".

Figure 4:
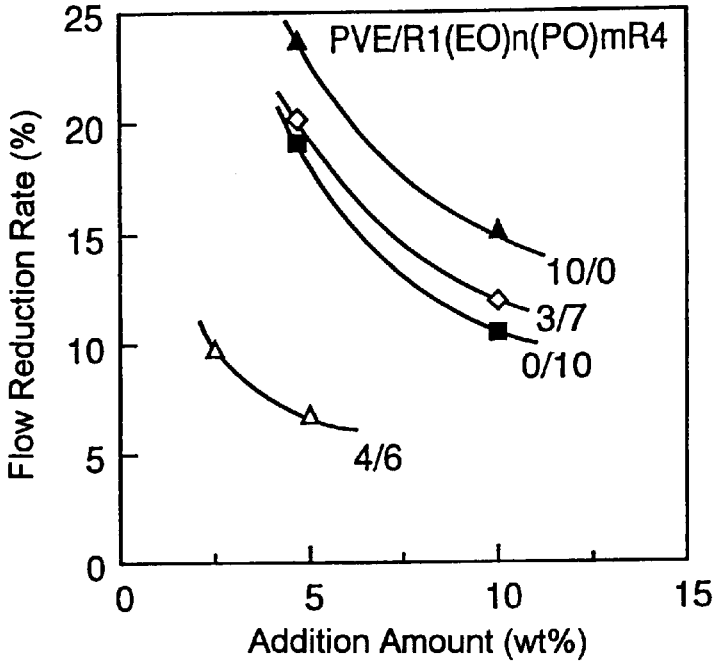
FIG. 4 is a view showing the relationship between the addition amount and the flow reduction rate when $R^1(EO)_n(PO)_mR4$ is added to PVE.

FIG. 4 shows the relationship between the addition amount and the flow reduction rate when $R^1(EO)_n(PO)_mR^4$ is added to a refrigerating machine oil PVE, wherein the carbon number of the alkylene group $R^2$ is 2 and the carbon number of the alkylene group $R^3$ is 3 in the above PAG. The numbers in FIG. 4 represent n/m. This figure indicates that the flow reduction rate becomes 5% or more regardless of n/m when the carbon numbers of alkylene groups $R^2$ and $R^3$ both are 3 or less and, in the case where the carbon numbers of the alkylene groups $R^2$ and $R^3$ are 3 or less, the flow reduction rate can not be decreased. Therefore, it is effective to decrease the flow reduction rate that the carbon number of the alkylene group $R^2$ is set to 4 or more.

Figure 5:
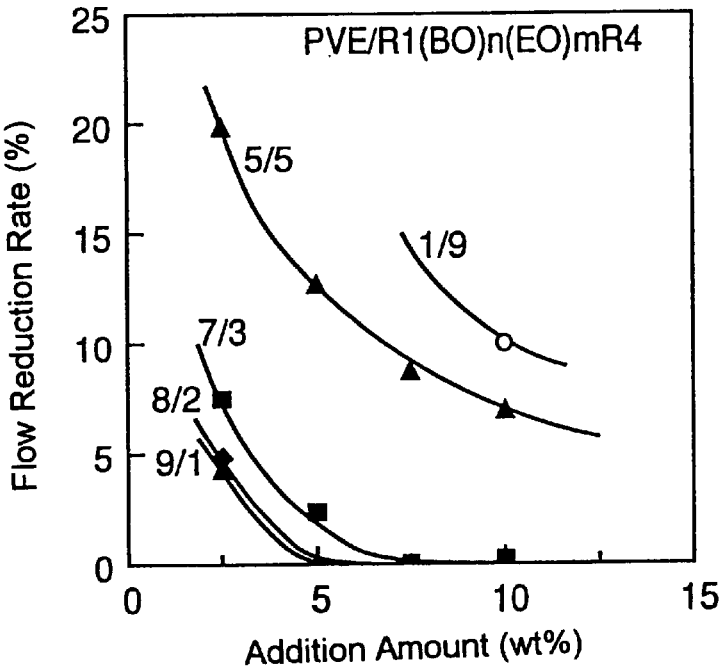
FIG. 5 is a view showing the relationship between the addition amount and the flow reduction rate when $R^1(BO)_n(EO)_mR^4$ is added to PVE.
Figure 6:
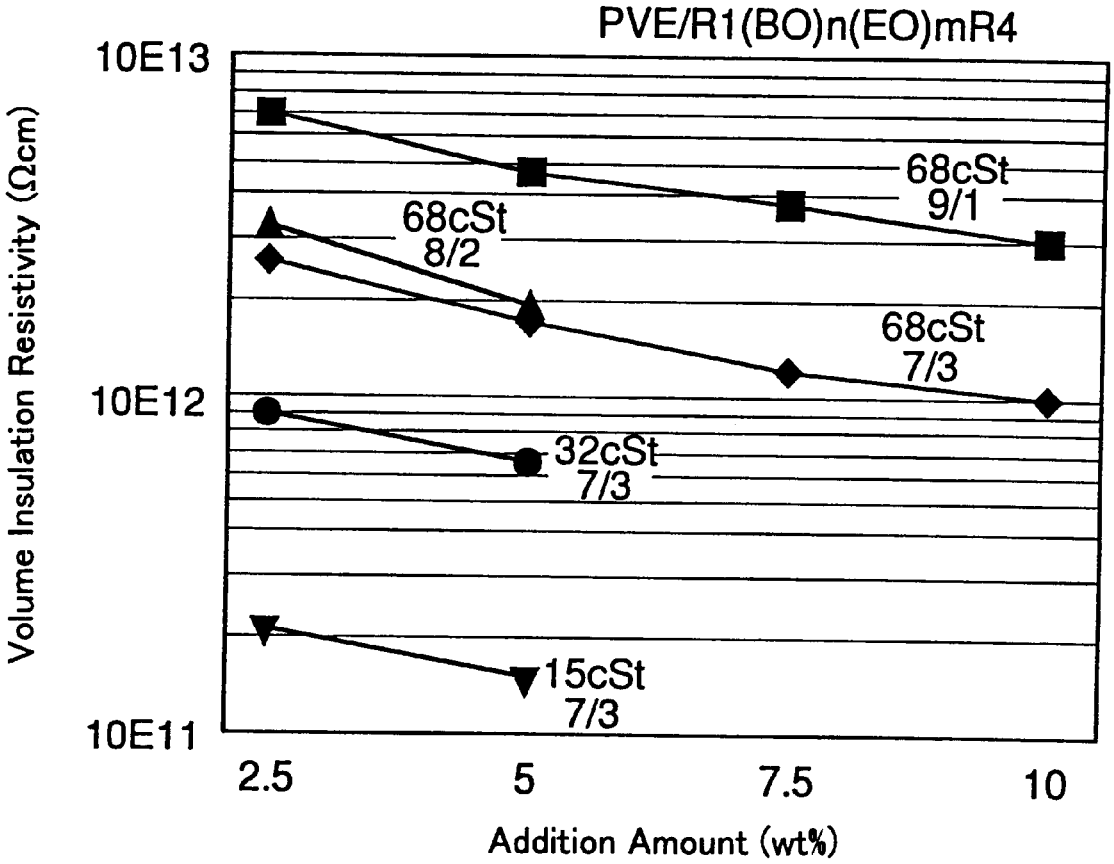
FIG. 6 is a view showing the relationship between the addition amount and the viscosity as well as the volume insulation resistivity when $R^1(BO)_n(EO)_mR^4$ is added to PVE.

FIG. 5 shows the relationship between the addition amount and the flow reduction rate when $R^1(BO)_n(EO)_mR^4$ is added to the above refrigerating machine oil PVE. Further, FIG. 6 shows the relationship between the addition amount and the volume insulating resistivity for the whole lubricating oil added with $R^1(BO)_n(EO)_mR^4$ when $R^1(BO)_n(EO)_mR^4$ is added to the above refrigerating machine oil PVE. The numbers in both figures represent n/m. FIG. 5 indicates that, in the case of n/m=1/9, 10% of the flow reduction rate can be obtained when the addition amount is 10 wt %. In addition, when the ratio n/m is increased, the flow reduction rate is 10% or less even when the addition amount is decreased from 10 wt %, and, thus, an effect to decrease the flow reduction rate is recognized in the range of n/m=1/9–10/0. Additionally, it is seen that, when the value of n/m is 7/3 or more, the flow reduction rate is remarkably low (0%–5%) and, in the case of n/m=5/5, the flow reduction rate is high. Further, FIG. 5 indicates that when the addition amount is 5 wt % or more, the flow reduction rate is rapidly decreased below 2.5%. However, as seen in FIG. 6, when the addition amount is increased above 10 wt %, the volume insulating resistance for the whole lubricating oil is decreased significantly.

That is, in this mode of the present invention, from the above points, when $R^1(BO)_n(EO)_mR^4$ is added to a refrigerating machine oil PVE, the above n/m is set to 9/1–10/0, and the addition amount is set to not less than 5 wt % and not more than 10 wt %. Additionally, when a distinct effects are desired, it is desirable that the value of n/m is set to 7/3 or more (7/3–10/0).

In addition, FIG. 6 shows the relationship between the viscosity of $R^1(BO)_n(EO)_mR^4$ (n/m=7/3) at 40° C. and the volume insulating resistivity for the whole lubricating oil. FIG. 6 indicates that the volume insulating resistance for the whole lubricating oil is significantly decreased when the viscosity becomes below 32 cSt. However, as described above, when the viscosity exceeds 70 cSt (40° C.), the molecular weight should be above several thousands, and the viscosity will increase to several ten-thousands cSt in a low-temperature region, such as a capillary tube, which may lead to clogging with $R^1(BO)_n(R^3O)_mR^4$ itself. Therefore, in this mode of the present invention, the viscosity of $R^1(BO)_n(R^3O)_mR^4$ at 40° C. is set to more than 32 cSt and not more than 70 cSt.

INDUSTRIAL APPLICABILITY

The lubricating oil for compression refrigerating machines according to the present invention is used together with HFC refrigerants to prevent choking caused by contaminants in capillary tubes and expansion valves without requiring any modifications of the refrigerating machines.

What is claimed is:

1. A lubricating oil composition for a compression refrigerating machine comprising a compressor and a motor accommodated in the compressor, which comprises a polyvinyl ether oil as a base lubricating oil, and an additive compound having the following general formula:

$$R^1(R^2O)_n(R^3O)_mR^4$$

wherein $R^1$ is an alkyl group, alkoxy group or aryl group;

$R^2$ is an alkylene group having a carbon number of 2–4;

$R^3$ is an alkylene group having a carbon number of 2–4;

$R^4$ is a hydrogen or an alkyl group; and n and m are integers; wherein the viscosity of said compound at 40° C. is 70 cSt or lower; wherein the amount of said compound to be added to the lubricating oil composition is not less than 0.1 wt % and not more than 20 wt %.

2. A polyvinyl ether lubricating oil composition for a compression refrigerating machine comprising a compressor and a motor accommodated in the compressor, which comprises a polyvinyl ether base lubricating oil and an additive compound having the following general formula present in an amount of not less than 5 wt % and not more than 10 wt %:

$$R^1(C_4H_8O)_n(R^5O)_mR^4$$

wherein $R^1$ is an alkyl group, alkoxy group or aryl group;

$R^4$ is a hydrogen or an alkyl group;

$R^5$ is an alkylene group having a carbon number of 2–3; and n and m are integers having a ratio n/m in the range: 1/9 to 10/0, wherein the viscosity of said compound at 40° C. is higher than 32 cSt and not higher than 70 cSt.

3. A refrigerating/air-conditioning machine comprising a compressor and a motor accommodated in the compressor, further comprising a working fluid comprised of a HFC refrigerant and a lubricating oil composition, wherein the composition comprises a polyvinyl ether oil as a base lubricating oil, and an additive compound having the following general formula:

$$R^1(R^2O)_n(R^3O)_mR^4$$

wherein $R^1$ is an alkyl group, alkoxy group or aryl group;

$R^2$ is an alkylene group having a carbon number of 2–4;

$R^3$ is an alkylene group having a carbon number of 2–4;

$R^4$ is a hydrogen or an alkyl group; and n and m are integers; wherein the viscosity of said compound at 40° C. is 70 cSt or lower; wherein the amount of said compound to be added to the lubricating oil composition is not less than 0.1 wt % and not more than 20 wt %.

4. The refrigerating/air-conditioning machine according to claim 3, wherein the motor accommodated in the compressor is a hermetic motor.

5. The refrigerator/air-conditioning machine according to claim 3 or 4, wherein the amount of said compound to be added to the lubricating oil composition is not less than 2 wt % and not more than 10 wt %.

6. The refrigerating/air-conditioning machine according to claim 3 or 4, wherein the carbon number of either of the alkylene groups $R^2$ and $R^3$ in said compound is 4.

7. A refrigerating/air-conditioning machine comprising a compressor and a motor accommodated in the compressor, further comprising a working fluid comprised of a HFC refrigerant and a polyvinyl ether lubricating oil composition, wherein the composition comprises a polyvinyl ether base lubricating oil and an additive compound having the following general formula present in an amount of not less than 5 wt % and not more than 10 wt %:

$$R^1(C_4H_8O)_n(R^5O)_mR^4$$

wherein $R^1$ is an alkyl group, alkoxy group or aryl group;

$R^4$ is a hydrogen or an alkyl group;

$R^5$ is an alkylene group having a carbon number of 2–3; and n and m are integers having a ratio n/m in the range: 1/9 to 10/0, wherein the viscosity of said compound at 40° C. is higher than 32 cSt and not higher than 70 cSt.

8. The refrigerating/air-conditioning machine according to claim 7, wherein the motor accommodated in the compressor is a hermetic motor.

9. The refrigerating/air-conditioning machine according to claim 7 or 8, wherein the ratio of n to m, n/m, in the general formula is 7/3 or more.

10. A method of lubricating a compression refrigerating machine comprising a compressor and a motor accommodated in the compressor, said method comprising the steps of: providing the refrigerating machine with a lubricating oil composition which comprises a polyvinyl ether oil as a base lubricating oil, and an additive compound having the following general formula:

$$R^1(R^2O)_n(R^3O)_mR^4$$

wherein $R^1$ is an alkyl group, alkoxy group or aryl group;

$R^2$ is an alkylene group having a carbon number of 2–4;

$R^3$ is an alkylene group having a carbon number of 2–4;

$R^4$ is a hydrogen or an alkyl group; and n and m are integers; wherein the viscosity of said compound at 40° C. is 70 cSt or lower; and lubricating said refrigerating machine with the lubricating oil composition; wherein the amount of said compound to be added to the lubricating oil composition is not less than 0.1 wt % and not more than 20 wt %.

11. A method of lubricating a compression refrigerating machine comprising a compressor and a motor accommodated in the compressor, said method comprising the steps of:

providing the refrigerating machine with a polyvinyl ether oil composition which comprises a polyvinyl ether base lubricating oil and an additive compound having the following general formula present in an amount of not less than 5 wt % and not more than 10 wt %:

$$R^1(C_4H_8O)_n(R^5O)_mR^4$$

wherein $R^1$ is an alkyl group, alkoxy group or aryl group;

$R^4$ is a hydrogen or an alkyl group;

$R^5$ is an alkylene group having a carbon number of 2–3; and n and m are integers having a ratio n/m in the range: 1/9 to 10/0, wherein the viscosity of said compound at: 40° C. is higher than 32 cSt and not higher than 70 cSt; and lubricating said refrigerating machine with the polyvinyl ether lubricating oil composition.

* * * * *